US008960300B2

(12) United States Patent
Cosgrove et al.

(10) Patent No.: US 8,960,300 B2
(45) Date of Patent: Feb. 24, 2015

(54) REMOTE SUBSEA CONNECTION EQUIPMENT

(75) Inventors: Patrick J Cosgrove, High Wycombe (GB); Terence Burgon, Crowmarsh (GB)

(73) Assignee: M.S.C.M. Limited, Buckinghamshire (GB)

( * ) Notice: Subject to any disclaimer, the term of this patent is extended or adjusted under 35 U.S.C. 154(b) by 66 days.

(21) Appl. No.: 13/337,413

(22) Filed: Dec. 27, 2011

(65) Prior Publication Data

US 2012/0193102 A1 Aug. 2, 2012

(30) Foreign Application Priority Data

Dec. 29, 2010 (GB) ..... 1022065.5

(51) Int. Cl.

| | |
|---|---|
| ***E21B 41/04*** | (2006.01) |
| ***E21B 34/04*** | (2006.01) |
| ***E21B 23/00*** | (2006.01) |
| ***E21B 33/035*** | (2006.01) |
| ***E21B 43/013*** | (2006.01) |

(52) U.S. Cl.

CPC ..... *E21B 33/0355* (2013.01); *E21B 43/013* (2013.01)

USPC ..... 166/338; 166/341; 166/342; 166/344

(58) Field of Classification Search

USPC ..... 166/338, 341–344, 360, 378–380, 85.1, 166/85.5

See application file for complete search history.

(56) References Cited

U.S. PATENT DOCUMENTS

| | | | | |
|---|---|---|---|---|
| 4,328,826 | A * | 5/1982 | Baugh | 137/236.1 |
| 4,382,717 | A * | 5/1983 | Morrill | 405/169 |
| 4,444,218 | A * | 4/1984 | Baugh | 137/236.1 |
| 4,489,959 | A | 12/1984 | Satterwhite | |
| 4,784,525 | A * | 11/1988 | Francois | 405/191 |
| 2004/0134662 | A1 * | 7/2004 | Chitwood et al. | 166/367 |
| 2004/0154804 | A1 * | 8/2004 | Williams | 166/345 |
| 2007/0173957 | A1 * | 7/2007 | Johansen et al. | 700/9 |
| 2011/0005764 | A1 * | 1/2011 | Bekkevold | 166/344 |
| 2012/0138306 | A1 * | 6/2012 | Berg | 166/349 |

OTHER PUBLICATIONS

Search Report for GB 1022065.5 dated Feb. 17, 2011.

* cited by examiner

*Primary Examiner* — Matthew Buck
*Assistant Examiner* — Stacy Warren
(74) *Attorney, Agent, or Firm* — Nixon & Vanderhye PC

(57) ABSTRACT

A subsea connection system includes a support unit with a first connector and a distribution unit including an external frame to be landed on and supported by the support unit and an inner frame that is movable within the external frame. An outwardly facing connector may be connected via a long umbilical to a remote platform. Nevertheless, a nearby installation may be controlled via a short umbilical from another connector and thus the nearby installation does not require a long umbilical connected to the remote platform.

9 Claims, 8 Drawing Sheets

REMOTE SUBSEA CONNECTION EQUIPMENT

PRIORITY

This application claims priority from GB patent application No. 1022065.5 filed Dec. 29, 2010, the disclosure of which is incorporated by reference.

FIELD OF THE INVENTION

This invention relates to subsea connection equipment intended for use in a remote location, e.g. at a substantial distance from a remote platform.

BACKGROUND OF THE INVENTION

Subsea oil wells and other subsea installations equipment are supplied with electrical power and hydraulic pressure from remote platforms. The hydraulic tubing and electrical cables from the platforms are usually bundled into one cable termed an umbilical. These bundles of tubes and cables may have diameters of 80 mm and be many kilometers long. The subsea end of the umbilical is often a stab plate on which the hydraulic tubes terminate in self-sealing couplings and the electrical cables terminate in electrical couplings. Remotely operated vehicles (ROVs) can pick up the carrier frame of an umbilical termination and mate it with a corresponding stab plate on a subsea structure. If this structure were a well head this well could then be operated from the platform. If more well heads or trees were added to the well complex, each would require its own full length umbilical from the platform. It is one object of the invention to make such an umbilical unnecessary.

SUMMARY OF THE INVENTION

In a preferred form of the invention, a subsea connection system comprises a support unit which includes a first connector, a distribution unit which comprises an external frame adapted to be landed on and supported by the support unit and an inner frame which is movable within the external frame. The inner frame comprises a second, inwardly facing connector positionable for mating with the said first connector of the support unit and at least two outwardly facing connectors each adapted for connection to a subsea umbilical.

In a preferred form the invention a subsea connection system comprises a support unit which includes a first connector, a distribution unit which comprises an external frame adapted to be landed on and supported by the support unit and an inner frame which is movable within the external frame. The inner frame comprises a second, inwardly facing connector positionable for mating with the said first connector of the support unit and at least two outwardly facing connectors each adapted for connection to a subsea umbilical.

In a preferred embodiment., the external frame has means such as two claws and a top bar for locating itself on the support unit when it is deployed. The inner frame may be locked in an outer position clear of the support unit's connector (such as a stab plate) in the external frame before the distribution unit constituted by the external and inner frames is landed on the support unit. The inner frame has at least three connectors which are preferably permanently interconnected within the inner frame.

The said second connector, which may be a stab plate with an associated clamping means, is preferably capable of slight free motion in the vertical plane within the inner frame. This enables a landed distribution unit to be made up to a docking flange of the support unit without passing the full load of the distribution unit onto the docking flange. The other two connectors are connection points for the attachment of an umbilical or a linking jumper umbilical. Thus whereas one of the other two connectors may be connected via a long umbilical to a remote platform, a nearby installation may be controlled via a short umbilical from the other one of the two connectors and does not require a long umbilical to the remote platform.

INTRODUCTION TO THE DRAWINGS

One example of the invention will be described with reference to the accompanying drawings, in which.

DETAILED DESCRIPTION

The figures illustrate a remote connection system which in the preferred form described below., provides a subsea installation with dual connection availability. The system comprises two main units, a support structure 1, particularly shown in FIGS. 1-3, and a distribution unit 2, particularly shown in FIGS. 4-8 and comprising an external frame 3 shown in FIGS. 4 and 5 and an inner frame 4, particularly shown in FIGS. 6-8. The support structure would normally be fixed to the structure of a subsea station. In this example, it carries a connector in the form of a male docking stab plate populated with couplings that are coupled to the equipment which they control. It also carries a guidance chute and claw pockets to accept the installation of the distribution unit by remote means.

The distribution unit is landed on the support structure with its claws engaging pockets on the support structure. A clamping unit with a connector in the form of a female docking stab plate within the distribution unit is made up to the male docking stab plate on the support structure. The distribution unit has two other connectors all permanently interconnected to the lines to the female docking stab plate. When a remote operated vehicle (ROV) connects an umbilical termination to one of these connectors, the station can be operated. Later a short jumper umbilical termination can be fitted by means of an ROV to the other connector to feed another remote connection system.

Figure 3:
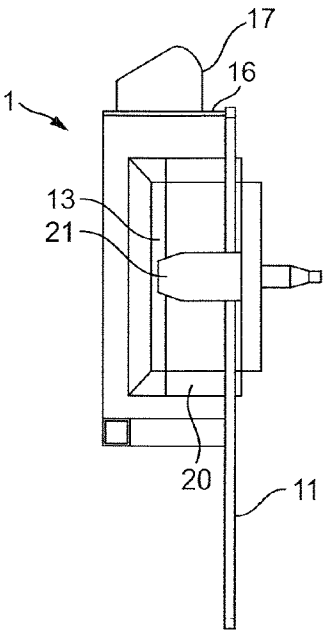
FIG. 3 is a side view of the support structure.
Figure 1:
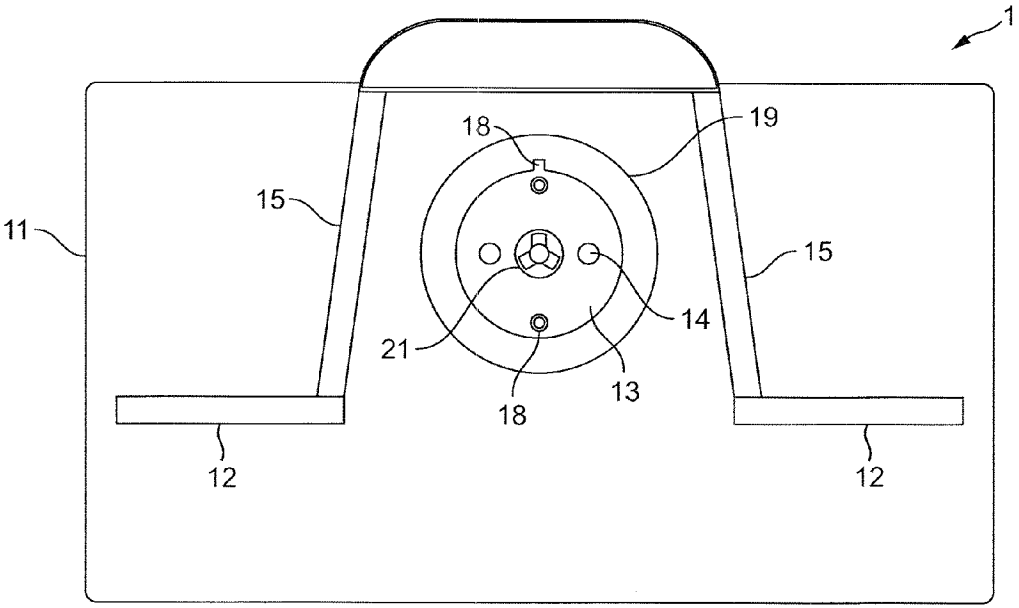
FIG. 1 is a front view of a support structure.
Figure 2:
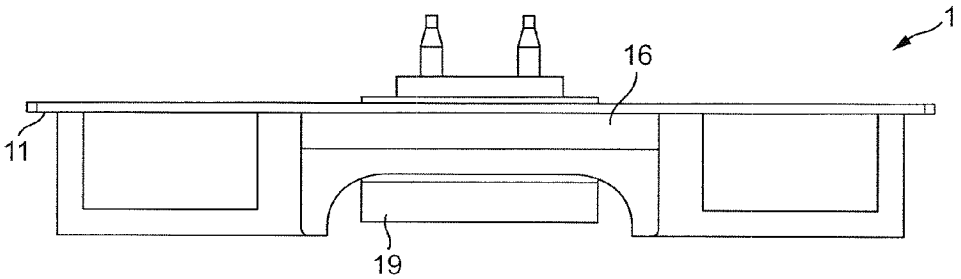
FIG. 2 is a top view of the support structure.

As is shown in FIGS. 1 to 3, the support unit 1 comprises a mounting plate 11 with two pockets 12 and a stab plate 13 which in this example is a 'male' stab plate carrying male couplers such as the coupler 14. The stab plate 13 is bounded at its sides by two angled plates 15 forming a guiding chute. The top of the unit 1 is formed by a horizontal plate 16 and a guide profile 17. The stab plate 13 carries two guide pins 18 and also carries a guide ring 19 on spacer bars 20. At its center is a probe 21 of a locking bolt such as described in U.S. Pat. No. 8,011,434 issued to Cosgrove et al on Sep. 6, 2011 and assigned to the same assignee as the present application.

The support structure is therefore adapted for the landing and support of a distribution unit, having a top bar and two pockets to capture the distribution unit when it is dropped onto the support structure, as will be described with reference to FIG. 9 et seq. The support structure is fixed to the subsea station, lines from the couplings on the stab plate running to the devices to be controlled.

Figure 4:
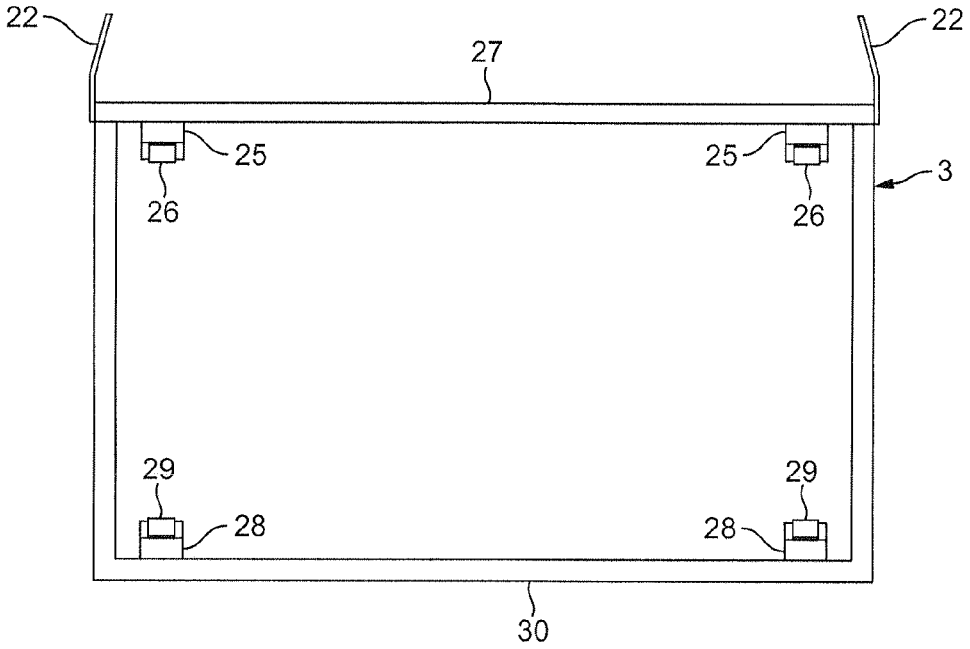
FIG. 4 is a front view of an outer frame.
Figure 5:
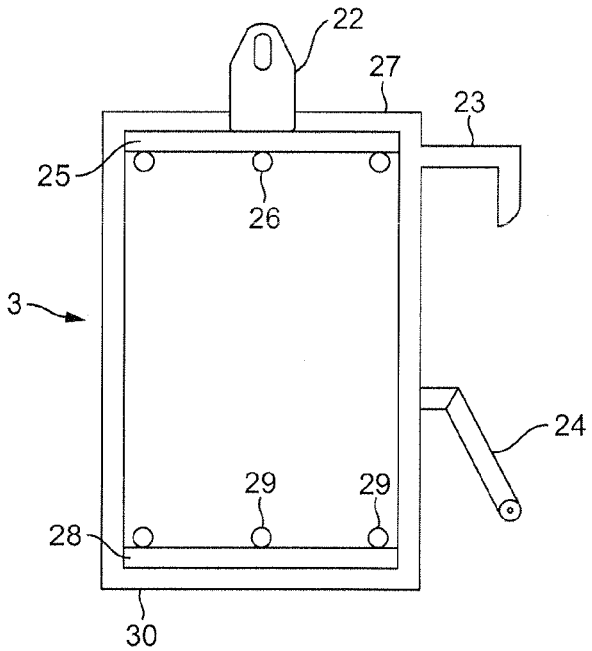
FIG. 5 is a side view of the outer frame.

FIGS. 4 and 5 illustrate the outer or external frame 3 of the distribution unit 2. The frame 3 has at each side a lifting lug 22, It has a top mounting bar 23 and a pair of lower claws 24 (FIG. 5). It has two tracks 25 each with rollers 26 under its top plate 27 and two tracks 28 each with rollers 29 on its base plate 30. Each of the tracks 25 and 28 is shown with three rollers. There could be more tracks and/or more rollers for each track.

Figure 6:
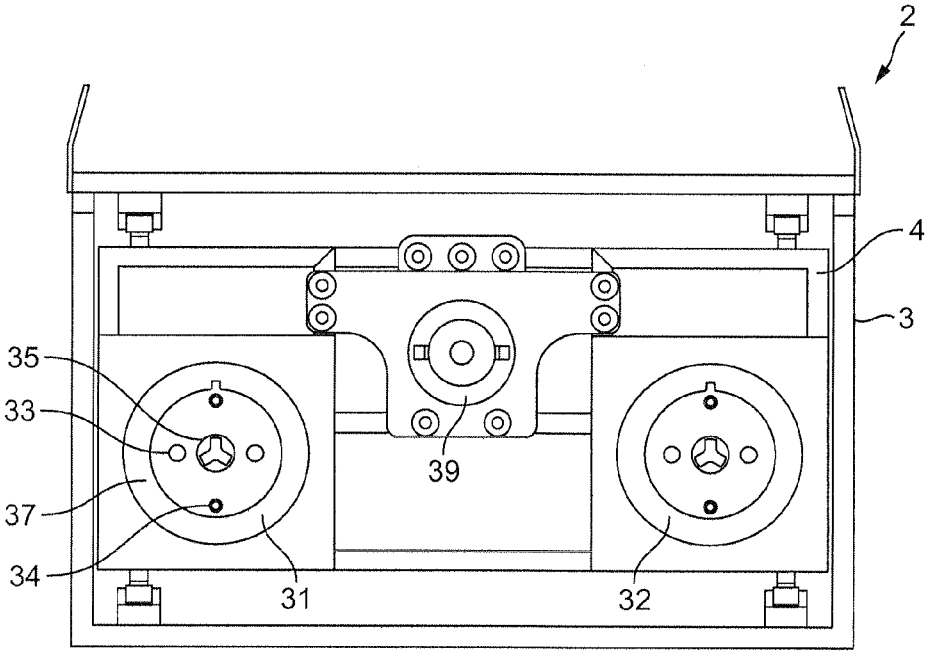
FIG. 6 is a rear view of an inner frame.
Figure 7:
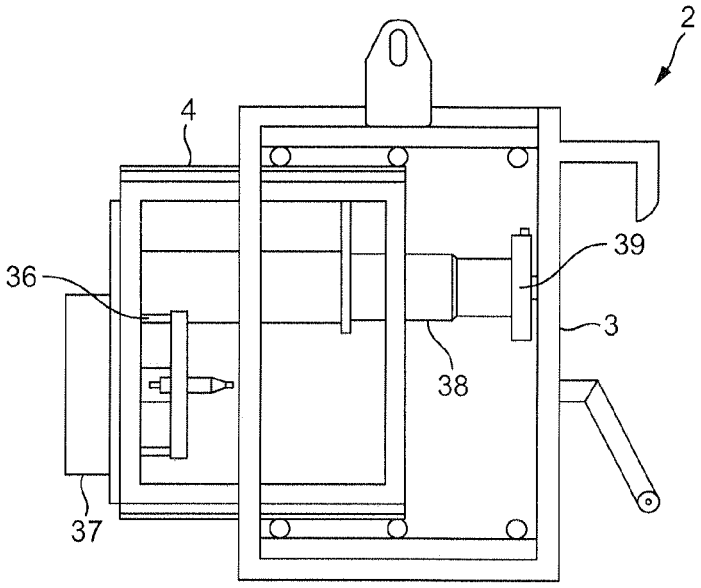
FIG. 7 is a side view of the inner frame located partly within the outer frame.

FIG. 6 shows the inner frame 4 assembled in an 'outer' position in the external frame 3. In this configuration the external frame can be landed on the support unit 1. The top and base of the inner frame 4 engage the rollers 26 and 29 respectively so that the inner frame can be readily moved inwards towards the support structure.

The inner frame 4 carries at its rear, as shown in FIG. 6, two connection points 31 and 32. Each can be connected to an umbilical. As is shown (for convenience) only for the connection point 31, it is in the form of a stab plate which includes 'male' couplers such as the coupler 33, guide pins such as the pin 34 and a locking bolt 35. The stab plate 31 is held by bars 36 from a guide ring 37.

The inner frame 4 also contains a clamping unit 38 which extends from the rear of the frame towards the stab plate 13 of the support unit 1 when the distribution unit 2 is mounted on the support unit 1. The clamping unit 38 carries a female stab plate 39 complementary to the stab plate 13 (i.e. in this example a female stab plate). The clamping unit 38 and accordingly the complementary stab plate 39 are capable of some slight movement (such as a few millimeters) in the vertical direction, so that the stab plates 13 and 39 may be made up without passing the full load of the distribution unit onto a docking flange.

The connection points, i.e. the stab plates 31, 32 and 39 of the distribution unit are interconnected. Preferably the interconnection is permanent. The particular nature depends on how many and what kind of couplers (hydraulic and/or electrical) are employed. The interconnection is schematically illustrated in FIG. 8.

Figure 8:
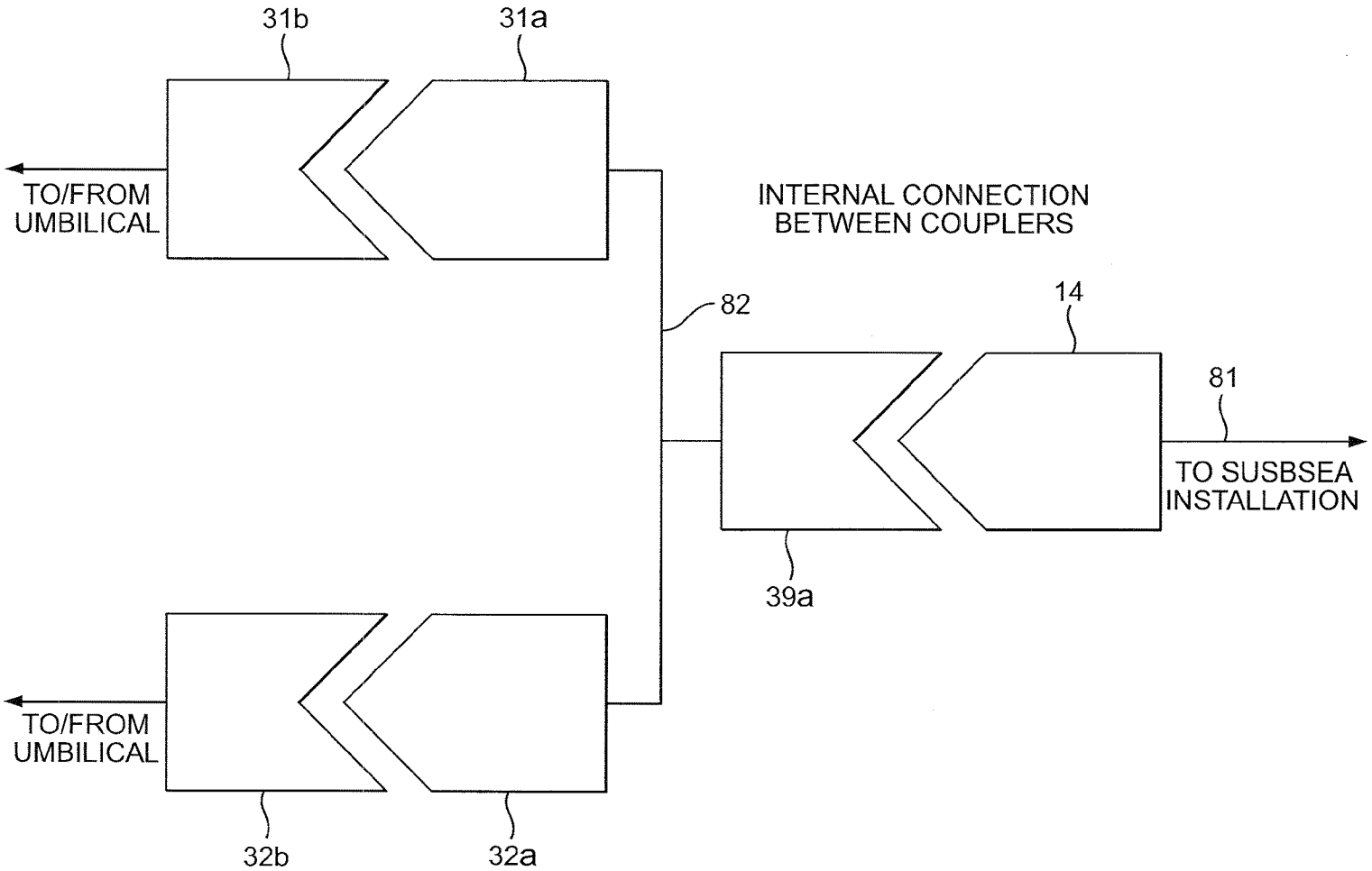
FIG. 8 is a schematic diagram of connections within the inner frame.

In FIG. 8 is shown a 'male' coupler 14 which as previously mentioned is carried on the stab plate 13 in the support unit. From the coupler 14 extends a line 81 to some controlled device or to a group of devices in the subsea installation. The coupler 14 is shown as mating with a 'female' coupler 39*a*, which is one of the couplers carried by the stab plate 39. The male couplers 31*a* and 32*a* are disposed respectively on the stab plates 31 and 32. The coupler 31*a* is shown as mating with a female coupler 31*b* which is part of an umbilical's terminating stab plate adapted to mate with the stab plate 31. Likewise the coupler 32*a* is shown as mating with a female coupler 32*b* which is part of an umbilical's terminating stab plate adapted to mate with the stab plate 32. The couplers 31*a*, 32*a* and 39*a* are all interconnected by internal pipework 82. Electrical connections would be provided where the couplers are electrical couplers.

Thus a supply of hydraulic pressure from a remote platform via an umbilical connected to the stab plate 31 may be supplied either to the installation or to another installation by way of a (short) umbilical connected to the stab plate 32.

FIGS. 9 to 12 illustrate the deployment of the distribution unit 2.

Figure 9:
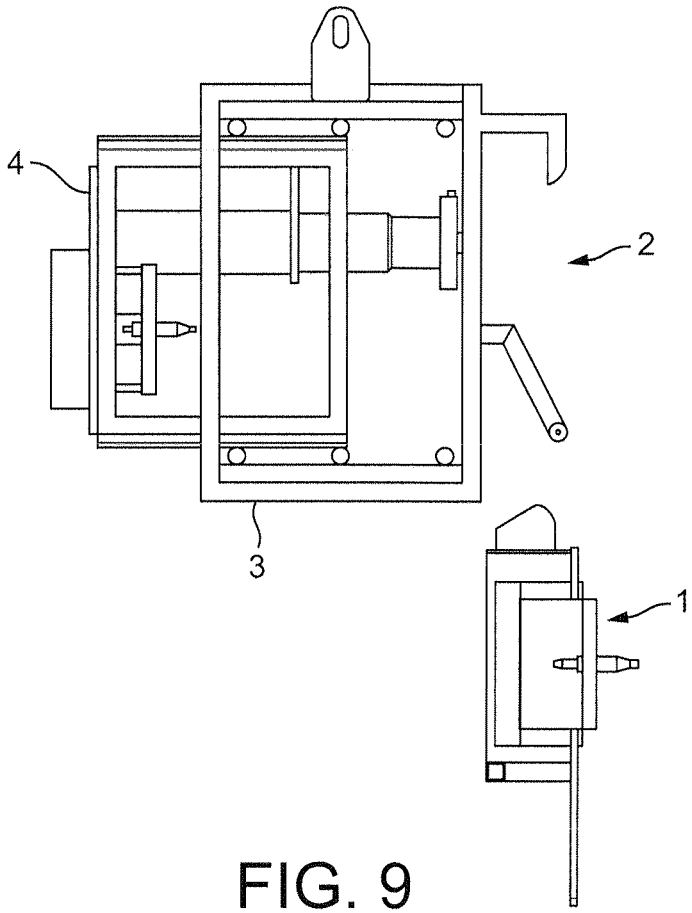
FIGS. 9 to 12 illustrate various phases in the deployment of the connection system.

FIG. 9 shows the distribution unit 2 with its inner frame 3 in a relatively outer position in the external frame. To deploy the distribution unit, it may be lowered by a crane from the surface towards the support unit 1. By means of the support unit's guide chute, positioning top bar and pockets the distribution unit 2 is landed on the support unit, the claws 24 landing in the pockets 12 of the support unit. Once the distribution unit has been landed the docking flanges (not shown) are made up.

Figure 10:
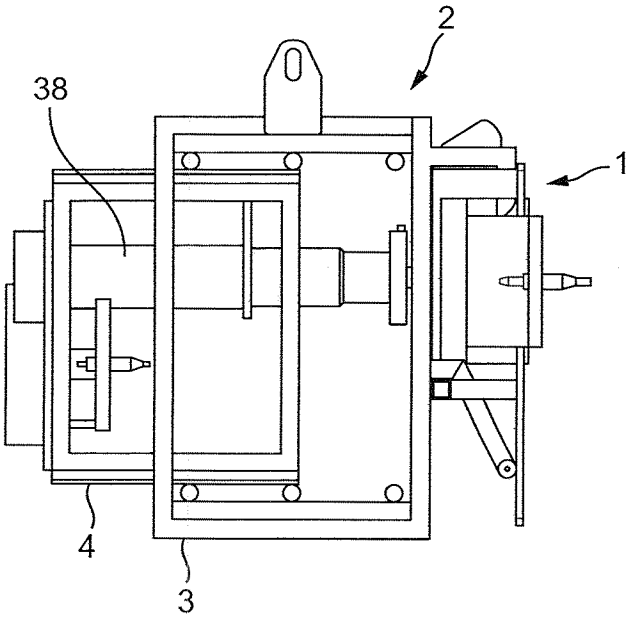
Figure 10:
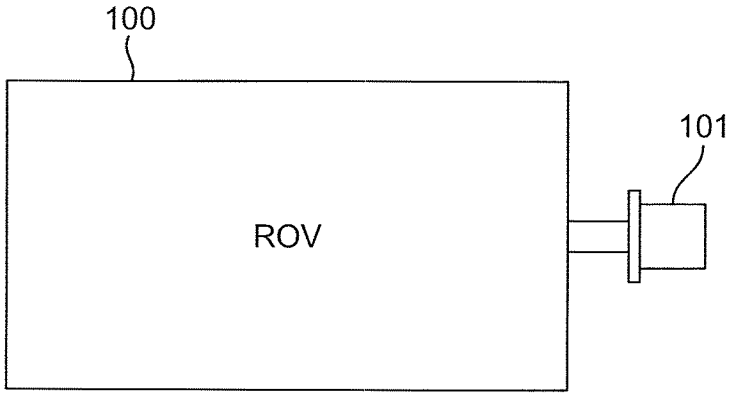

FIG. 10 illustrates an ROV 100 which 'flies' in and by means of a clamping tool 101 engages a torque bucket (not shown) of the clamping unit 38. The small vertical freedom of the clamping unit permits the ROV (with its limited thrust) to push the inner frame 4 onto the docking probe and into the docking flange. The ROV 100 then rotates the clamp screw until the male and female stab plates 14 and 39 are fully made up. This action has fully locked the distribution unit 2 to the support unit 1 so that no further locking action is required of the ROV. The clamping device must be able to withstand the full ROV torque, typically 2700 Newton-meters.

Figure 11:
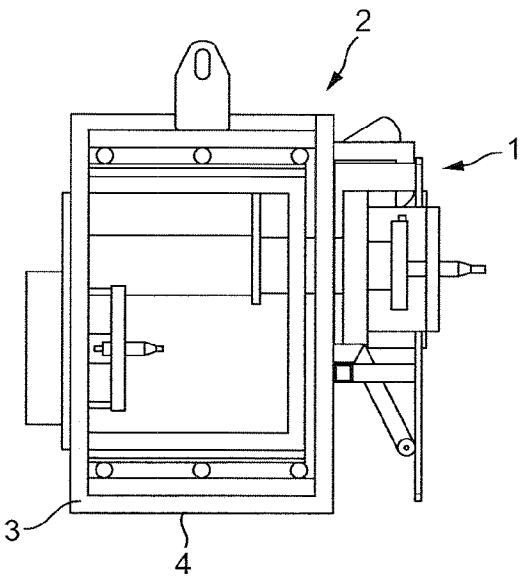
Figure 11:
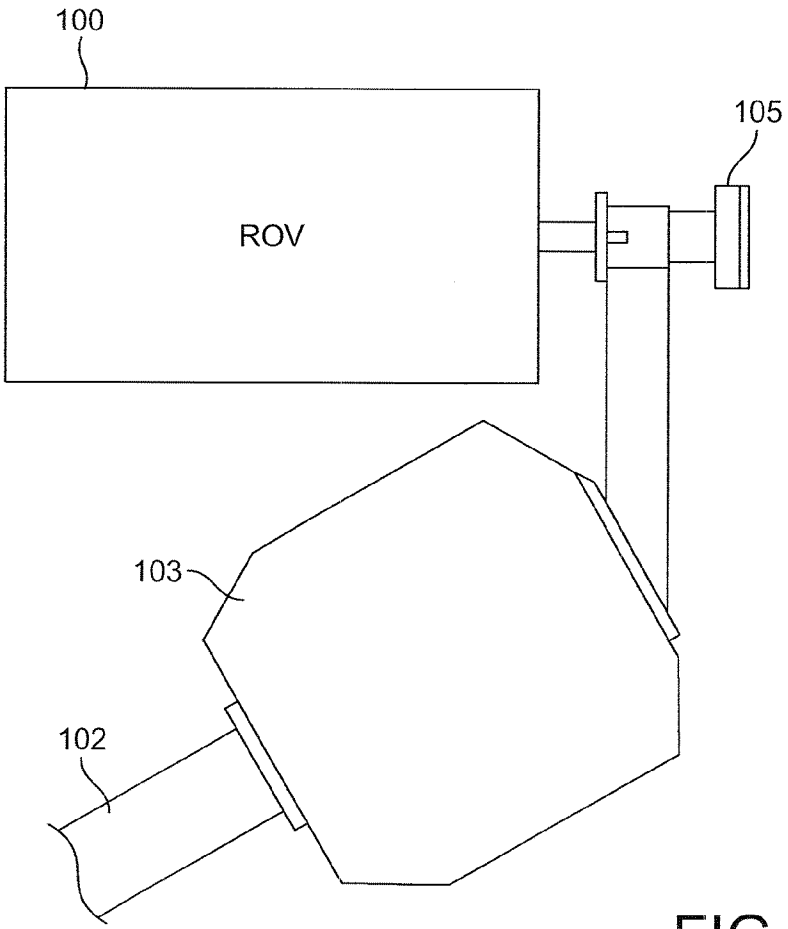
Figure 12:
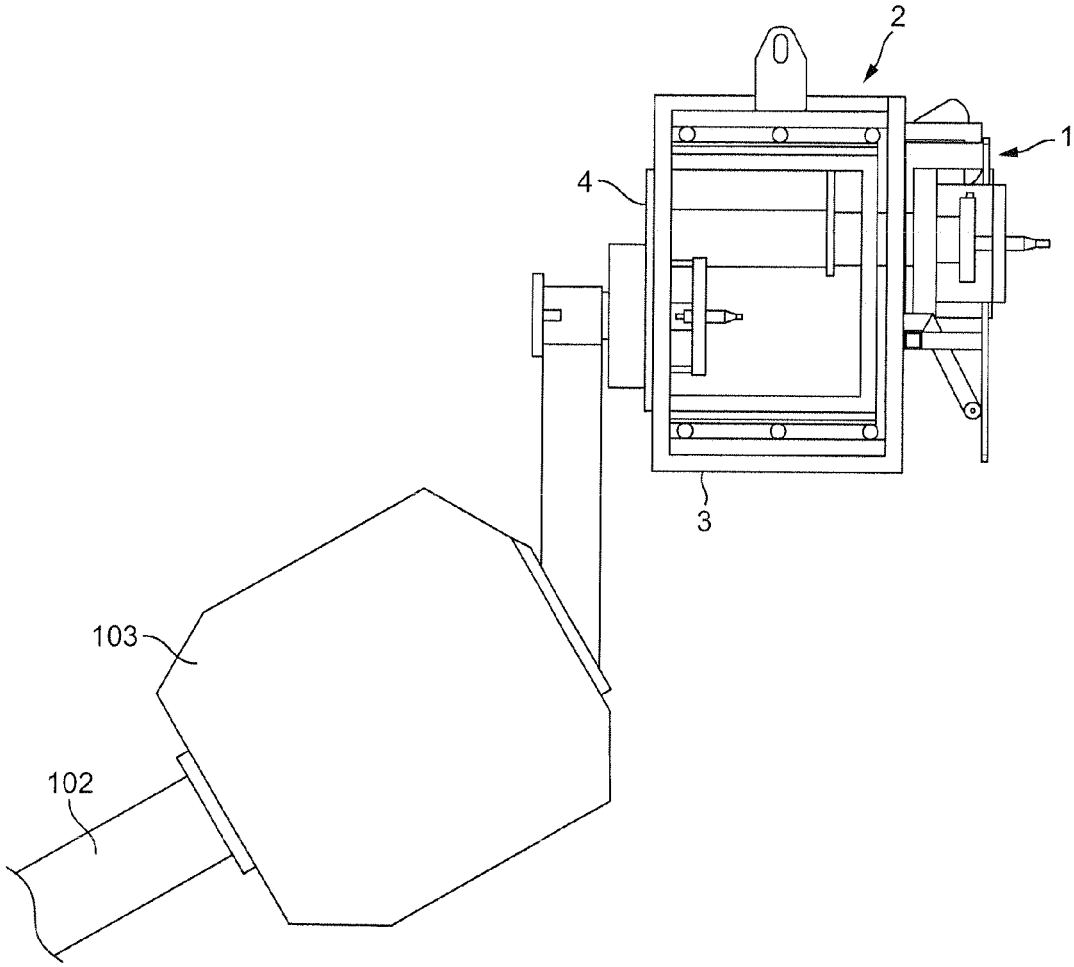

When the distribution unit is made up to the support unit an umbilical 102 can now be connected to either one of the umbilical connectors 31 and 32. The ROV engages (as shown in FIG. 11) a clamping device 105 on a carrier frame 103 plus umbilical, inserts the clamping device 105 into the connector 31 or 32 and rotates the clamp screw to make up the respective stab plates. In this condition (FIG. 12), the subsea installation (such as a well) can be controlled from the surface, the remaining connector 31 or 32 not being used.

Later a nearby well may be fitted with an identical remote connection system but in this case a long umbilical is avoided because a short linking umbilical can be taken from the spare umbilical connector on the first remote connection system. This technique of supplying control or power to first one well system, but also providing an access point for the same control to another well system, is capable of extension to as many well heads as there are in the complex, all being supplied by means of a single main umbilical from the surface.

The components of the remote connection system components are substantial pieces of equipment which are associated with considerable forces when being made up (and when necessary to be disconnected). Clamp mechanisms can weigh 100 kg and from the ROV torque create clamping forces of more than 250,000 Newtons to clamp up a male and female stab plate assembly. Containing such forces and withstanding the umbilical's weight may require an inner frame 4 weighing approx 1 ton and a distribution unit of approx 3 tons. Disconnecting stab plates containing hydraulic couplings subsea produces a vacuum resistance against separation. This resisting force increases with depth and can require the unclamping mechanism to supply a force of 100,000 Newtons to pry the stab plates apart. Although the mechanisms are large the requirement is that the inner frame 4 be movable by an ROV of restricted thrust, say 2000 Newtons.

When the distribution unit 2 is to be landed on the support unit 1 the inner frame 4 must be in the outer position to have clearance from the docking stab plate on the support unit 1. After the distribution unit 2 lands on the support unit 1 the ROV must push the inner frame in to make up the connection. The low force available makes the provision of wheeled tracks top and bottom preferable. There may be a further safety feature of low friction plastic runners on the tracks to allow movement even if the wheels should jam in the subsea environment.

A special feature of this design is the lack of activity required of the ROV. When the distribution unit has been landed on the support unit 1 and made up the connection system is immediately operable because the claw and clamp arrangement form a complete locking system. There is no need for the ROV to use additional locking pins or clamp arrangements to prevent the system decoupling.

Various modifications may be made to the equipment as described in the foregoing, it being intended that the invention be limited only by the spirit of the claims that follow.

What we claim is:

1. A subsea connection system comprising:

a support unit which includes a first stab plate assembly; and a self-contained distribution unit which comprises an external frame and an inner frame, wherein said self-contained distribution unit is adapted to be landed on and supported by said support unit;

wherein said inner frame is movable within said external frame, said inner frame comprising a second stab plate assembly facing in a first direction and positionable for mating with the said first stab plate assembly of the support unit and also comprising, at least third and fourth stab plate assemblies, each of said third and fourth stab plate assemblies facing in a second direction opposite said first direction and being adapted and positioned for connection to a respective subsea umbilical, wherein said second, third and fourth stab plate assemblies are all connected together for the transfer of at least one of hydraulic pressure and electrical power;

wherein each of said first, second, third and fourth stab plate assemblies comprises a multiplicity of couplers for hydraulic and/or electrical connection with respective complementary couplers;

whereby to provide electrical and/or hydraulic connection between a first subsea umbilical, and said first stab plate assembly when said first subsea umbilical is connected to said third stab plate assembly, and also to provide electrical and/or hydraulic connection between said first subsea umbilical and a second subsea umbilical, when said first subsea umbilical is connected to said third stab plate assembly and said second subsea umbilical is connected to said fourth stab plate assembly.

2. The subsea connection system of claim 1 in which said inner frame includes a clamping unit for the mating of said second stab plate assembly with said first stab plate assembly and for the movement of said inner frame towards said support unit.

3. The subsea connection system of claim 2 in which said clamping unit is operable by a remotely operated vehicle.

4. The subsea connection system of claim 2 in which said clamping unit has a vertical positioning tolerance which avoids its loading by the weight of said distribution unit.

5. The subsea connection system of claim 1 wherein the support unit and distribution unit are configured for landing of the distribution unit onto the support unit by vertically lowering the distribution unit onto the support unit and wherein said inner frame is disposed for orthogonal horizontal movement on rollers with respect to said external frame.

6. The subsea connection system as in claim 1 wherein said third and fourth stab plate assemblies are disposed side-by-side and face in the same direction.

7. A subsea connection system comprising:

a support unit which includes a first stab plate assembly; and a self-contained distribution unit, which comprises an external frame and an inner frame, wherein said self-contained distribution unit is adapted to be landed on and supported by said support unit; and wherein said inner frame is movable within said external frame, said inner frame comprising a second stab plate assembly facing in a first direction and positionable for mating with the said first stab plate assembly of the support unit and also comprising third and fourth stab plate assemblies, each of said third and fourth stab plate assemblies facing in a second direction opposite said first direction and being adapted and positioned for connection to a subsea umbilical;

wherein:

each of said first, second, third and fourth stab plate assemblies comprises a multiplicity of couplers for hydraulic and/or electrical connection with respective complementary couplers;

said second, third and fourth stab plate assemblies are all connected together for the transfer of at least one of hydraulic pressure and electrical power;

whereby to provide electrical and/or hydraulic connection between a first subsea umbilical connected to said third stab plate assembly and said first stab plate assembly, when said first subsea umbilical is connected to said third stab plate assembly, and also to provide electrical and/or hydraulic connection between said first subsea umbilical and a second subsea umbilical, when said first subsea umbilical is connected to said third stab plate assembly and said second subsea umbilical is connected to said fourth stab plate assembly;

said inner frame includes a clamping unit for the mating of said second stab plate assembly with said first and for the movement of said inner frame towards said support unit;

said clamping unit has a vertical positioning tolerance which avoids its loading by the weight of said distribution unit; and said inner frame is disposed for horizontal movement on rollers with respect to said external frame.

8. The subsea connection system as in claim 7 wherein said third and fourth stab plate assemblies are disposed side-by-side and face in the same direction.

9. A subsea distribution unit for use with a support unit including a first stab plate assembly, said distribution unit being self-contained and comprising an external frame and an inner frame with said inner frame being movable within the external frame, said distribution unit being adapted to be landed on and supported by said support unit including a first stab plate assembly, said distribution unit further comprising:

a second stab plate assembly facing in a first direction positionable for mating with said first stab plate assembly of the support unit and at least third and fourth stab plate assemblies, said third and fourth stab plate assemblies facing in a second direction opposite said first direction and being disposed side-by-side, each of said third and fourth stab plate assemblies being adapted and positioned for connection to a respective subsea umbilical, wherein said second, third and fourth stab plate assemblies are all connected together for the transfer of at least one of hydraulic pressure and electrical power; and wherein each of said first, second, third and fourth stab plate assemblies comprises a multiplicity of couplers for hydraulic and/or electrical connection with respective complementary couplers;

whereby to provide electrical and/or hydraulic connection between a first subsea umbilical and said second stab plate assembly, when said first subsea umbilical is connected to said third stab plate assembly, and also to provide electrical and/or hydraulic connection between said first subsea umbilical and a second subsea umbilical, when said first subsea umbilical is connected to said third stab plate assembly and said second subsea umbilical is connected to said fourth stab plate assembly.

* * * * *